US008388318B2

(12) United States Patent
Tolbert, Jr.

(10) Patent No.: US 8,388,318 B2
(45) Date of Patent: Mar. 5, 2013

(54) HERMETIC CRANKCASE HEATER

(75) Inventor: John W. Tolbert, Jr., Bristol, TN (US)

(73) Assignee: Bristol Compressors International, Inc., Bristol, VA (US)

( * ) Notice: Subject to any disclaimer, the term of this patent is extended or adjusted under 35 U.S.C. 154(b) by 311 days.

(21) Appl. No.: 12/755,356

(22) Filed: Apr. 6, 2010

(65) Prior Publication Data

US 2010/0254834 A1 Oct. 7, 2010

Related U.S. Application Data

(60) Provisional application No. 61/166,930, filed on Apr. 6, 2009.

(51) Int. Cl.
*F04D 29/58* (2006.01)
*F04D 25/06* (2006.01)

(52) U.S. Cl. ..... 417/313; 417/902

(58) Field of Classification Search ..... 417/410.1, 417/357, 410.3, 415; 92/144
See application file for complete search history.

(56) References Cited

U.S. PATENT DOCUMENTS 1,614,168 A * 1/1927 Abbott ..... 219/540
1,806,512 A 5/1931 Wiegand
3,213,263 A 10/1965 Steenbergen
3,426,962 A * 2/1969 Shaw ..... 417/13
3,497,677 A 2/1970 Blain
3,577,741 A 5/1971 Shaw
3,739,076 A 6/1973 Schwartz
4,395,618 A 7/1983 Cunningham
4,454,381 A 6/1984 Ito et al.
4,480,174 A 10/1984 Hummel
4,523,935 A 6/1985 Takagi et al.
4,549,037 A 10/1985 Bawa et al.
4,689,878 A 9/1987 Beauregard et al.
4,755,657 A 7/1988 Crim et al.
4,800,732 A * 1/1989 Newton ..... 62/236
5,136,143 A 8/1992 Kutner et al.
5,194,717 A 3/1993 Cowen et al.
5,230,222 A 7/1993 Erbs
5,252,036 A 10/1993 Bunch et al.
5,584,716 A 12/1996 Bergman
5,633,978 A 5/1997 Hofsass
5,828,810 A 10/1998 Frank et al.
6,361,281 B1 3/2002 Wurth et al.
6,372,993 B1 * 4/2002 Eckels et al. ..... 174/152 GM
6,472,637 B2 10/2002 Ballem
6,486,442 B2 * 11/2002 Wheeler ..... 219/243
6,591,621 B2 7/2003 Loprete et al.
6,616,416 B1 9/2003 Tolbert, Jr.
6,807,821 B2 * 10/2004 Narney, II ..... 62/324.6
6,834,513 B2 12/2004 O'Brien et al.
6,901,675 B2 6/2005 Edwards et al.
6,971,860 B2 12/2005 Gilliam et al.

(Continued)

FOREIGN PATENT DOCUMENTS

EP 1724562 A2 11/2006
WO 0017586 3/2000

*Primary Examiner* — Devon Kramer
*Assistant Examiner* — Andrew A Horton
(74) *Attorney, Agent, or Firm* — McNees Wallace & Nurick LLC

(57) ABSTRACT

A heater is provided inside a hermetic compressor to heat the fluid in an oil sump of the compressor. The heater can be substantially submerged in the fluid even at low fluid levels. The heater can raise the temperature of the fluid to a predetermined temperature to substantially maintain non-lubricant fluids in a gaseous state and prevent non-lubricant fluids from mixing with the lubricant in the sump. A feed through assembly in the compressor housing is used to supply power to both the compressor motor and the heater.

20 Claims, 4 Drawing Sheets

U.S. PATENT DOCUMENTS 6,982,400 B1 * 1/2006 Nguon ..... 219/548
7,037,091 B2 5/2006 Chumley et al.
7,059,839 B2 6/2006 Haller et al.
7,074,022 B2 7/2006 Majerus et al.
2002/0148629 A1 * 10/2002 Honkomp et al. ..... 174/50.52
2006/0182635 A1 * 8/2006 Jayanth ..... 417/44.1
2007/0022765 A1 2/2007 Lifson et al.
2007/0032909 A1 2/2007 Tolbert, Jr. et al.
2007/0110599 A1 * 5/2007 Suss ..... 417/415
2009/0050351 A1 * 2/2009 Tolbert, Jr. ..... 174/152 R

* cited by examiner

HERMETIC CRANKCASE HEATER

CROSS-REFERENCE TO RELATED APPLICATIONS

This application claims priority from and the benefit of U.S. Provisional Application No. 61/166,930, entitled HERMETIC CRANKCASE HEATER, filed Apr. 6, 2009 which is hereby incorporated by reference.

BACKGROUND

The application generally relates to the heating of oil in a hermetically sealed compressor. More specifically, the application is directed to the heating of oil in a hermetically sealed compressor with a heating element positioned inside the compressor housing (outer shell) and at least partially submerged within the oil of the oil sump of the compressor.

A hermetic compressor can use oil to lubricate the mechanical components of the compressor. The oil used by the compressor collects in an oil sump located at the base (or lower section) of the compressor housing. During operation of the compressor, the oil is pumped or drawn into the moving compressor components from the oil sump.

One application of a hermetically sealed compressor is in a heating, ventilation, air conditioning and refrigeration (HVAC&R) system. The compressor in an HVAC&R system is used to compress the gaseous refrigerant that is used in the HVAC&R system. However, when the compressor is not operating, some of the gaseous refrigerant in the compressor may condense and drain into the oil sump or be absorbed by the oil if the ambient temperature conditions support the migration of refrigerant into the oil. Such condensation/absorption of the refrigerant can cause dilution of the oil, which may limit the ability of the oil to properly lubricate the mechanical components of the compressor.

In some compressors, the oil in the oil sump can be heated in order to prevent migration of liquid refrigerant into the compressor oil or to evaporate any refrigerant condensate that accumulates in the oil. To heat the oil, a heater assembly can be positioned in a heater well that extends through the compressor housing and is located near the oil sump. However, because of compressor design considerations, the heater well is positioned perpendicularly to, and substantially within, the generally cylindrical side of the compressor housing. The side-mount configuration of the heater well can result in the heater well not always being substantially submerged within the oil of the oil sump. In addition, the heater well may not efficiently transfer heat from the heater to the oil and may cause a significant amount of sound and other vibrations to be projected out into the environment during the operation of the compressor. Further, the use of a heater well requires coating the inside of the well and/or the outer surface of the heater with a heat transfer compound that is subject to dissipation over time resulting in a degradation of heating performance. Another recurring issue with the use of a heater well is refrigerant leaks at the heater well and housing interface due to poor weld joints and cracks that can form in the compressor housing.

Other compressors may use heating elements that are mounted on the exterior wall of the compressor housing and do not function within a heater well. The heating elements used on these compressors heat the housing, which then transfers heat to the oil, resulting in low heating efficiency due to losses to the surrounding air, slow heat transfer to the oil and the heating of the entire housing.

Therefore, what is needed is a heater that is positioned below the oil level of the oil sump and that is fully contained within the compressor housing.

SUMMARY

The present invention is directed to a compressor having a housing, a motor positioned in the housing, and a compression device positioned in the housing. The compression device is driven by the motor. The compressor also includes a heater to heat fluid in the housing and a feed through device positioned in the housing. The heater is positionable in the housing to be in direct contact with the fluid. The feed through device is configured to provide a direct power connection through the housing for the motor and the heater. The feed through device includes a plurality of conductors. The plurality of conductors are connected to the heater and the motor inside the housing and connected to a voltage source outside the housing.

The present invention is further directed to a system for heating oil sump fluid in a compressor. The system includes a heater to heat oil sump fluid in the compressor and a feed through device positionable in a housing of the compressor. The heater is positionable in the compressor to be in direct contact with the oil sump fluid and to be substantially submerged in the oil sump fluid. The feed through device is configured to provide a direct power connection through the housing for the heater and a motor for the compressor. The feed through device includes a plurality of conductors. The plurality of conductors are connected to the heater and the motor inside the housing and connected to a voltage source outside the housing.

One advantage of the present application is improved heat transfer between the heater and the oil within the oil sump.

Another advantage of the present application is the elimination of the heater well and the possibility of leaks and cracks in the compressor housing as a result of the heater well.

Yet another advantage of the present application is that both the heater and the compressor motor can be powered with a common terminal configuration.

Other features and advantages of the Application will be apparent from the following more detailed description of the preferred embodiment(s), taken in conjunction with the accompanying drawings which show, by way of example, the principles of the Application. In addition, alternative exemplary embodiments relate to other features and combinations of features as may be generally recited in the claims.

BRIEF DESCRIPTION OF THE FIGURES

Wherever possible, the same reference numbers will be used throughout the drawings to refer to the same or like parts.

DETAILED DESCRIPTION OF THE EXEMPLARY EMBODIMENTS

Figure 1:
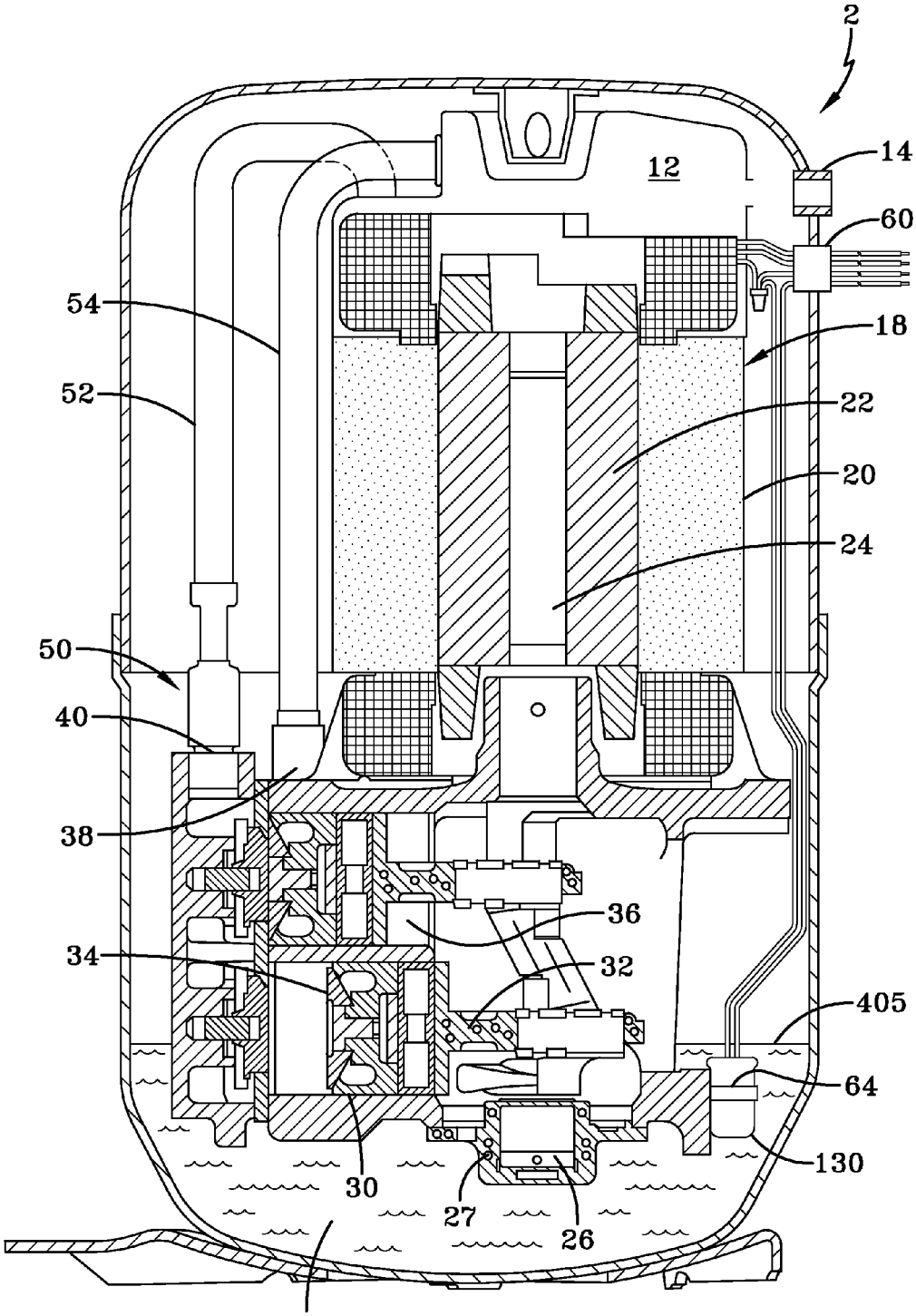
FIG. 1 shows an embodiment of a hermetically sealed compressor with a heating element.

Before turning to the figures, which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

The heater of the present application is designed to function with many types of hermetic compressor systems, including systems that utilize single or multiple compression devices, motors and auxiliary components. The hermetic compressor housing can have an upper and lower section which both have substantially cylindrical portions and which, when mated, form a generally cylindrical shell. The lower section may have a base portion that is positioned adjacent to and below the substantially cylindrical portion. In addition, one embodiment of the hermetic compressor housing can have a shell with an upper and lower section which, when mated, form a generally oval shell.

An oil sump is located in the interior of the lower section of the compressor housing. The oil sump generally includes oil, but may include oil mixed with condensed refrigerant. The fluid within the oil sump, whether oil, refrigerant, other lubricant, or other liquid is referred to herein as oil sump fluid. During operation of the compressor, refrigerant is pumped or circulated through the compressor and remains in a vapor state as the refrigerant flows through the compressor. However, when the compressor is not in operation, the vapor refrigerant may condense and drain into the oil sump at the base of the compressor or be absorbed by the oil if ambient temperature conditions support the migration of the refrigerant into the oil.

The oil in the oil sump occupies at least a preselected minimum volume of the lower section of the compressor to adequately lubricate the compressor. The preselected minimum volume may be occupied when the oil in the oil sump does not contain any refrigerant. When the oil occupies the preselected minimum volume within the compressor, the oil rises to a preselected minimum height measured from the bottom or base of the compressor. The drainage or absorption of condensed refrigerant into the oil sump increases the volume of the oil sump fluid above the preselected minimum volume. Further, the presence of any liquid refrigerant within the oil sump fluid increases the level of the oil sump fluid above the preselected minimum height.

To remove liquid refrigerant from the oil sump, the oil sump fluid can be heated to a temperature sufficient to evaporate liquid refrigerant in the oil sump. The evaporation of the liquid refrigerant can be accomplished by the transmission of heat directly from a heater to the oil sump fluid to heat the oil sump fluid thereby evaporating liquid refrigerant located in the oil sump fluid and preventing migration of refrigerant into the oil sump fluid. In one embodiment, the heater can be operated for a preselected time period before the start-up of the compressor.

FIG. 1 illustrates an exemplary embodiment of a hermetic compressor. Compressor 2 may be connected to a refrigeration or HVAC&R system (not shown) having a condenser, expansion device and evaporator in fluid communication with the compressor 2. The compressor 2 is shown as a reciprocating compressor, but can be any suitable type of hermetic compressor including, but not limited to, a rotary, scroll, screw, or centrifugal compressor. The compressor 2 can be connected to an evaporator (not shown) by a suction line that enters the suction port 14 of compressor 2. The suction port 14 can be in fluid communication with a suction plenum 12. Refrigerant gas from the evaporator enters the compressor 2 through the suction port 14 and then flows to the suction plenum 12 before being compressed. In one embodiment, the refrigerant gas from the suction port 14 can fill the interior space of the compressor housing before flowing to the suction plenum.

The compressor 2 can use an electrical motor 18. As shown in FIG. 1, motor 18 is an induction motor having a stator 20 and a rotor 22, however any other suitable type of electrical motor may be used. A shaft assembly 24 extends through the rotor 22. The bottom end 26 of the shaft assembly 24 extends into an oil sump 405 and includes a series of apertures 27. Connected to the shaft assembly 24 below the motor is a compression device, such as a piston assembly 30 as shown in FIG. 1. In FIG. 1, the piston assembly 30 has two pistons. A connecting rod 32 is connected to a piston head 34, which moves back and forth within a cylinder 36. The cylinder 36 includes a gas inlet port 38 and a gas discharge port 40. Associated with these ports 38, 40 are associated suction valves and discharge valves. The gas inlet port 38 is connected to an intake tube 54, which is in fluid communication with the suction plenum 12.

The motor 18 can be activated by a signal in response to the satisfaction of a predetermined condition, for example, an electrical signal from a thermostat when a preset temperature threshold is reached. While a thermostat is used as an example, it should be known that any type of device or signal may be used to activate the compressor. When the compressor is activated, electricity is supplied to the stator 20, and the windings in the stator 20 cause the rotor 22 to rotate. Rotation of the rotor 22 causes the shaft assembly 24 to turn. When the shaft assembly 24 is turning, oil sump fluid in the oil sump 405 enters the apertures 27 in the bottom end 26 of the shaft and then moves upward through and along the shaft 24 to lubricate the moving parts of the compressor 2.

Rotation of the rotor 22 also causes reciprocating motion of the piston assembly 30. As the assembly 30 moves to an intake position, the piston head 34 moves away from gas inlet port 38, the suction valve opens and refrigerant fluid is introduced into an expanding cylinder 36 volume. The gas is pulled from the suction plenum 12 through the intake tube 54 to the gas inlet port 38 where the gas passes through the suction valve and is introduced into the cylinder 36. When the piston assembly 30 reaches a first end (or top) of its stroke, shown by movement of the piston head 34 to the right side of the cylinder 36 of FIG. 1, the suction valve closes. The piston head 34 then compresses the refrigerant gas by reducing the cylinder 36 volume. When the piston assembly 30 moves to a second end (or bottom) of its stroke, shown by movement of piston head 34 to the left side of cylinder 36 of FIG. 1, a discharge valve is opened and the compressed refrigerant gas is expelled through the gas discharge port 40. The compressed refrigerant gas flows from the gas discharge port 40 into a muffler 50 then through an exhaust or discharge tube 52 to exit the compressor 2 into a conduit connected to a condenser.

The motor 18 can be positioned within the top portion of the compressor 2, and the piston assembly 30 can be positioned below the motor 18. The oil sump 405 can be located at the bottom portion of the compressor 2. In one embodiment, a portion of the piston assembly 30 can be submerged below the oil level in the oil sump 405. When the compressor is not operating, some of the refrigerant in compressor 2 may condense and fall by force of gravity into the oil sump 405 and mix with the oil in the oil sump 405 or be absorbed into the oil in the oil sump. The oil in the oil sump 405 is used to lubricate the mechanical portions of the compressor 2, such as shaft assembly 24. When liquid refrigerant mixes with the oil, the resulting liquid is a less effective lubricant. To avoid this problem, the oil sump fluid is heated and the refrigerant is evaporated from the oil, leaving oil in the oil sump 405 to lubricate the components.

In FIG. 1, a heater 130 is shown located within the oil sump and mounted to the piston assembly 30. In another embodiment, the heater 130 can be partially submerged in the oil sump 405. Power is provided to the heater 130 and to the motor 18 of the compressor 2 by use of a common feed through assembly 60 that can be positioned in the top portion of the compressor 2. The heater 130 may be secured to any suitable structure inside the compressor shell, including the compressor shell, with a clip 64, or other suitable fastening device.

The feed through assembly 60 is used to provide power to the compressor motor 18 and the heater 130. The feed through assembly 60 can eliminate all inside and outside terminal connections for the motor 18 and heater 130, which can improve the reliability of the compressor. In addition to the elimination of the terminal connections, the power terminal fences, fence covers, and cover gaskets can also be eliminated with the use of the feed through assembly 60. The weld housing of the feed through assembly is welded or brazed or otherwise suitably secured into the compressor shell during fabrication and is then later used to house the feed through body 68 (see FIG. 2). The feed through body 68, with its integral wiring, can be connected into the motor stator and heater during fabrication. Upon placement of the stator and heater in the compressor, the feed through lead wire assembly can be pulled through the weld housing to its inherent stop position. A snap ring device 76 is then used to secure the assembly in place.

Figure 2:
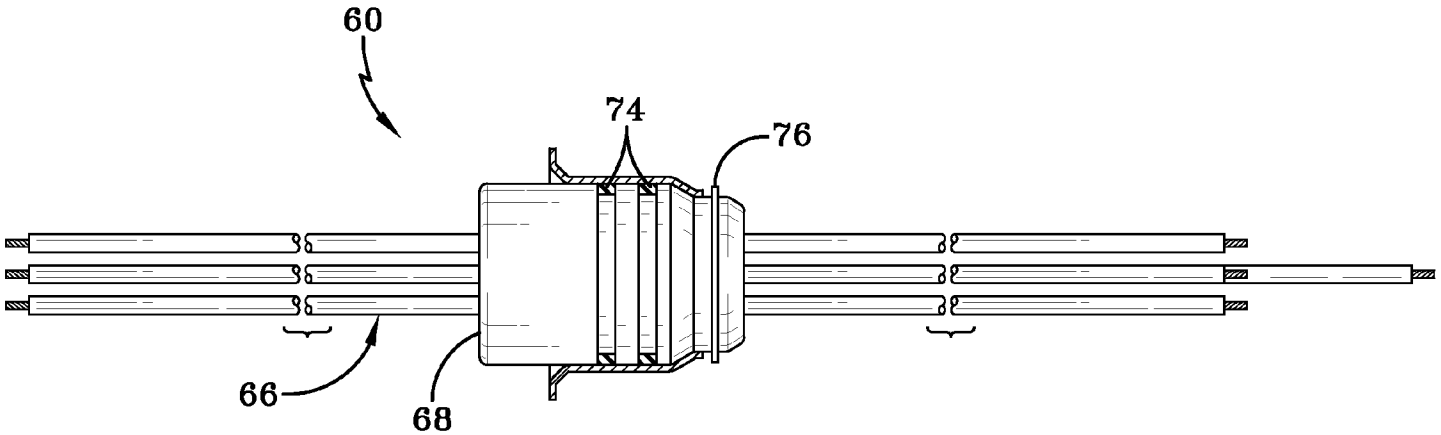
FIG. 2 shows a side view of an embodiment of a feed through assembly.
Figure 3:
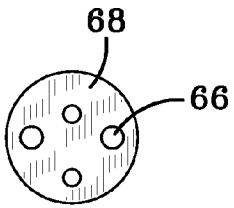
FIG. 3 shows an end view of the feed through assembly of FIG. 2.

FIGS. 2 and 3 illustrates a more detailed look at one embodiment of a feed through assembly 60. One exemplary embodiment of a feed through assembly is described in U.S. Patent Application Publication No. 2009/0050351 A1, which publication is hereby incorporated by reference. However, it should be understood that any suitable embodiment of a feed through assembly may be used with compressor 2. The feed through assembly 60 can include four lead wires or conductors, two for the stator, one for the heater, and one that is shared by the stator and the heater. In one embodiment, the conductors or wires can be constructed or fabricated from copper or other suitable materials. The body 68 of the feed through assembly 60 includes grooves for o-rings 74 and also a single groove for a snap ring 76. The o-rings 74 are used to create the hermetic seal once the body 68 is installed in the weld housing. The lead wires 66 may be secured to the components within the compressor 2, and then passed through the body 68 of the feed through assembly 60, or the components may be pre-connected to the lead wires by the stator supplier.

Figure 4:
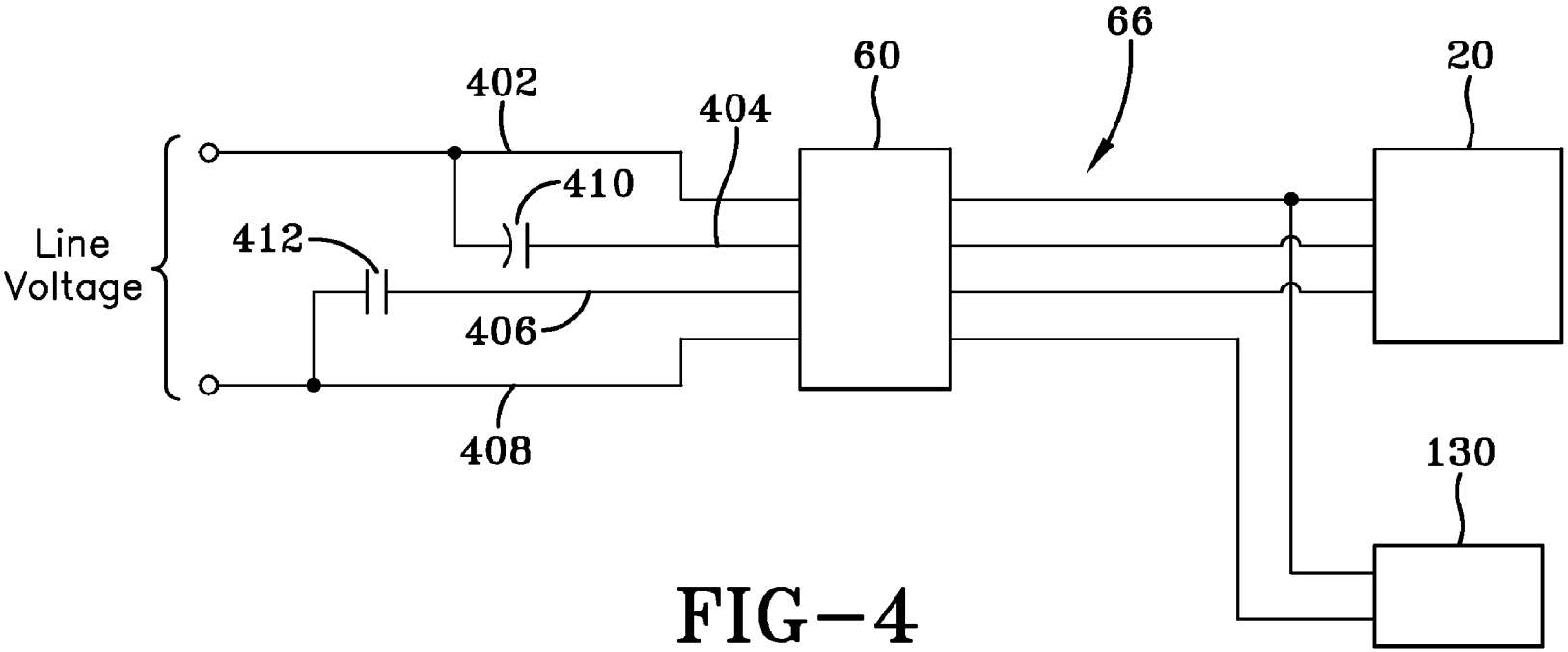
FIG. 4 schematically shows an embodiment of a wiring connection for the motor and heater.

FIG. 4 schematically shows an embodiment of a wiring configuration that can be used for heater 130 and stator 20. Wires or conductors 402, 404, 406, 408 can be connected to a voltage source or line voltage. In one embodiment, the line voltage can be between 100 and 600 VAC and can be single phase or multi-phase (single phase is shown in FIG. 4). Conductors 402, 404 and 406 can travel or pass through feed through assembly 60 to stator 20. Conductor 408 can travel or pass through feed through assembly 60 to heater 130. As shown in FIG. 4, conductor 402 is jumpered or connected from stator 20 to heater 130. However, in another embodiment, conductor 402 can travel through feed through assembly 60 to heater 130 and then can be jumpered or connected to stator 20. Conductor 404 can include a capacitor 410 connected between the voltage source and the stator 20 to assist with operation of the motor 18. Conductor 406 can include a contactor or switch 412 connected between the voltage source and the stator 20. Contactor or switch 412 can be open or closed as needed for starting and/or operating the motor 18. In one exemplary embodiment, conductors 402, 404, 406, 408 are continuous from feed through assembly 60 to stator 20 or heater 130, but may include one or more terminal connections between the voltage source and feed through assembly 60.

In an exemplary embodiment, the heater 130 can be configured to withstand the environment within the compressor housing including the harsh conditions of being exposed to oil and refrigerant continually. In addition, the heater is also configured to sufficiently heat the oil within the housing to evaporate the refrigerant from the oil.

Figure 5:
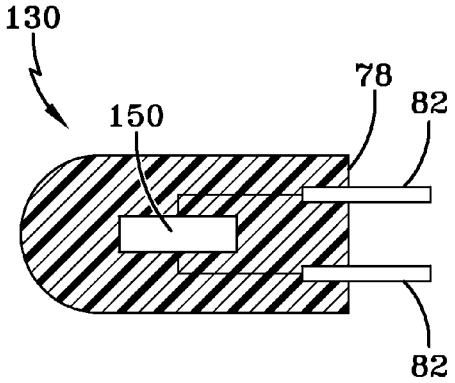
FIGS. 5-8 show alternate embodiments of a heating element.

FIG. 5 illustrates an embodiment of the heater 130. An epoxy, rubber or polymer body 78 is used for a heating element 150. Heating element 150 can be a positive temperature coefficient (PTC) pill or other suitable component that can generate heat upon the application of electric current. The heating element 150 and related components, such as power supply wires, pins or conductors, can be totally encapsulated by the epoxy, rubber or polymer material that forms body 78. Body 78 can provide a fluid tight housing for heating element 150 that is compatible with the refrigerant and lubricant used by the compressor 2. Connection points 82 can remain uncovered by the epoxy, rubber or polymer material to permit connection to appropriate conductors 66 from feed through assembly 60. In another exemplary embodiment, the appropriate conductors 66 from feed through assembly 60 can be directly connected to heating element 150. In one embodiment, heater 130 can operate by applying electric current to heating element 150, which generates heat and raises the temperature of body 78, which can thereby raise the temperature of the oil sump fluid.

Figure 6:
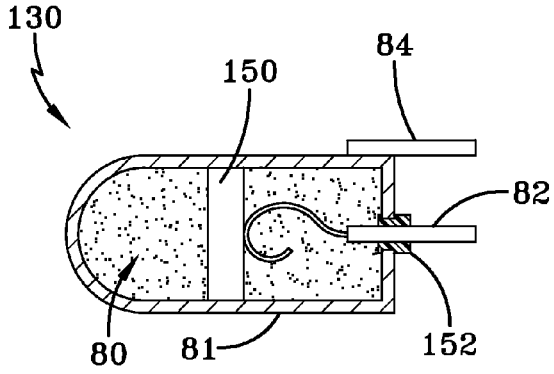

FIG. 6 illustrates another embodiment of the heater 130. A metal housing 81 can be used for the heating element 150. Heating element 150 can be positioned in the metal housing 81 such that at least a portion of the heating element 150 is in contact with metal housing 81 to form a electrical connection. The metal housing 81 can include a connection point 84 that is either connected to metal housing 81 or an integral part of metal housing 81. A second connection point 82 can include a wire or conductor that travels or passes through metal housing 81 to provide power to one side of the heating element 150. Second connection point 82 can be electrically isolated from metal housing 81. The entire interior of the housing 81 can be filled with a heat transfer medium or material 80. Any suitable seal 152, such as a glass seal or epoxy seal, can be used where connection point 82 enters metal housing 81 to isolate connection point 82 and provide a fluid tight seal for heating element 150. Connection point 82 and connection point 84 can be connected to appropriate conductors 66 from feed through assembly 60. In one embodiment, heater 130 can operate by applying electric current to heating element 150, which generates heat and raises the temperature of heat transfer material 80 and metal housing 81, which can thereby raise the temperature of the oil sump fluid.

Figure 7:
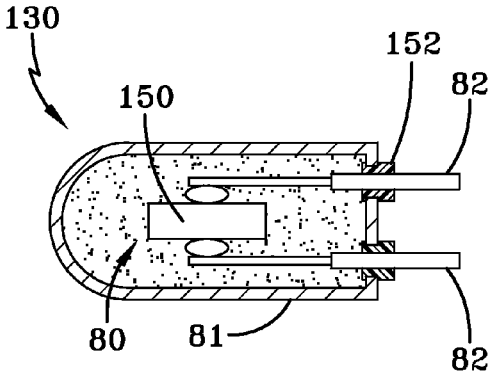

Another embodiment of the heater 130 is illustrated in FIG. 7. A metal housing 81 can be used for the heating element 150. Connection points 82 can include wires, pins or conductors that travel or pass through metal housing 81 to provide power to the heating element 150. Connection points 82 can be electrically isolated from metal housing 81. The entire interior of the housing 81 can be filled with a heat transfer medium or material 80. Any suitable seal 152, such as a glass seal or epoxy seal, can be used where connection points 82 enter metal housing 81 to isolate connection points 82 and provide a fluid tight seal for heating element 150. Connection points 82 can be connected to appropriate conductors 66 from feed through assembly 60. In another exemplary embodiment, the appropriate conductors 66 from feed through assembly 60 can be directly connected to heating element 150. In one embodiment, heater 130 can operate by applying electric current to heating element 150, which generates heat and raises the temperature of heat transfer material 80 and metal housing 81, which can thereby raise the temperature of the oil sump fluid.

Another embodiment includes a variance of the embodiments shown in FIGS. 6 and 7. The alternate embodiment can uses a resistive heating element coupled to a bi-metal temperature control for the heating element 150. The bi-metal temperature control can be similar to overload motor protectors used with hermetic compressors.

Figure 8:
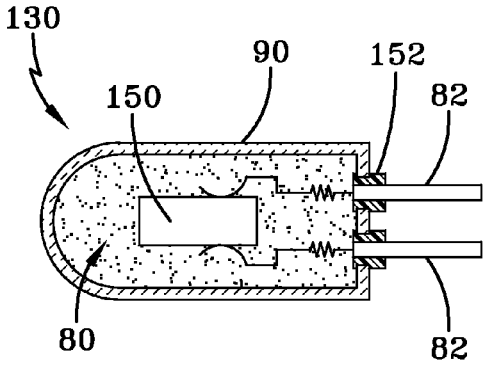

Still another embodiment of the heater 130 is illustrated in FIG. 8. A ceramic housing 90 can be used for the heating element 150. Connection points 82 can include wires, pins or conductors that travel or pass through ceramic housing 90 to provide power to the heating element 150. Connection points 82 can be electrically isolated from ceramic housing 90. The entire interior of the housing 90 can be filled with a heat transfer medium or material 80. Any suitable seal 152, such as a glass seal or epoxy seal, can be used where connection points 82 enter ceramic housing 90 to isolate connection points 82 and provide a fluid tight seal for heating element 150. Connection points 82 can be connected to appropriate conductors 66 from feed through assembly 60. In another exemplary embodiment, the appropriate conductors 66 from feed through assembly 60 can be directly connected to heating element 150. In one embodiment, heater 130 can operate by applying electric current to heating element 150, which generates heat and raises the temperature of heat transfer material 80 and ceramic housing 90, which can thereby raise the temperature of the oil sump fluid. In still another embodiment, the heating element 150 can be encased in entirely in ceramic material, similar to the embodiment shown in FIG. 5.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

a housing;

a motor positioned in the housing;

a compression device positioned in the housing, the compression device being driven by the motor;

a heater to heat fluid in the housing, the heater being positionable in the housing to be in direct contact with the fluid; and a fasting device to secure the heater within the housing, the fastening device being located entirely inside the housing;

a feed through device positioned in the housing, the feed through device being configured to provide a direct power connection through the housing for the motor and the heater, the feed through device comprising a plurality of conductors, the plurality of conductors being connected to the heater and the motor inside the housing and connected to a voltage source outside the housing; and power to the motor from the voltage source being controlled separately from power to the heater from the voltage source.

2. The compressor of claim 1 wherein the heater comprises a heating element and a plurality of connection points electrically connected to the heating element, the heating element being configured to generate heat upon application of an electric current to the plurality of connection points.

3. The compressor of claim 2 wherein the heater comprises a body and the heating element is positioned in the body.

4. The compressor of claim 3 wherein the body is formed from one of a epoxy material, a rubber material or a polymer material, and the heating element is encapsulated by the material forming the body.

5. The compressor of claim 3 wherein the body comprises a heater housing and the heating element is positioned in the heater housing.

6. The compressor of claim 5 wherein the heater housing is formed from one of a metal or a ceramic material.

7. The compressor of claim 6 wherein the heater housing is formed of metal and the heater housing comprises at least one of the plurality of connection points.

8. The compressor of claim 5 wherein at least one of the plurality of connection points is isolated from the heater housing by one of a glass seal or an epoxy seal.

9. The compressor of claim 5 wherein the heater comprises a heat transfer material and the heat transfer material is positioned in the heater housing.

10. The compressor of claim 1 wherein the plurality of conductors comprises four conductors, two conductors of the four conductors are used to provide power to the motor, one conductor of the four conductors is used to provide power to the heater and one conductor of the four conductors is used to provide power to both the motor and the heater.

11. A system for heating oil sump fluid in a compressor comprising:

a heater to heat liquid located in a sump fluid in the compressor, the heater being mounted to a component located entirely inside a housing of the compressor to be in direct contact with the liquid located in the sump and to be substantially submerged in the liquid in the sump; and a feed through device positionable in the housing of the compressor, the feed through device being configured to provide a direct power connection through the housing for the heater and a motor for the compressor, the feed through device comprising a plurality of conductors, the plurality of conductors being directly connected to the heater and the motor inside the housing and connected to a voltage source outside the housing; and power to the motor from the voltage source being controlled separately from power to the heater from the voltage source.

12. The system of claim 11 wherein the heater comprises a heating element and a plurality of connection points electrically connected to the heating element, the heating element being configured to generate heat upon application of an electric current to the plurality of connection points.

13. The system of claim 12 wherein the heater comprises a body and the heating element is positioned in the body.

14. The system of claim 13 wherein the body is formed from one of a epoxy material, a rubber material or a polymer material, and the heating element is encapsulated by the material forming the body.

15. The system of claim 13 wherein the body comprises a heater housing and the heating element is positioned in the heater housing.

16. The system of claim 15 wherein the heater housing is formed from one of a metal or a ceramic material.

17. The system of claim 16 wherein the heater housing is formed of metal and the heater housing comprises at least one of the plurality of connection points.

18. The system of claim 15 wherein at least one of the plurality of connection points is isolated from the heater housing by at least one of a glass seal or an epoxy seal.

19. The system of claim 15 wherein the heater comprises a heat transfer material and the heat transfer material is positioned in the heater housing.

20. The system of claim 11 wherein the plurality of conductors comprises four conductors, two conductors of the four conductors are used to provide power to the motor, one conductor of the four conductors is used to provide power to the heater and one conductor of the four conductors is used to provide power to both the motor and the heater.

* * * * *